US007467980B2

(12) United States Patent
Chiu

(10) Patent No.: US 7,467,980 B2
(45) Date of Patent: Dec. 23, 2008

(54) FEMALE CONNECTOR TERMINAL FOR ELECTRIC POWER CONNECTOR

(75) Inventor: Shu-Yi Chiu, Panchiso (TW)

(73) Assignee: Alltop Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 11/873,420

(22) Filed: Oct. 17, 2007

(65) Prior Publication Data

US 2008/0242151 A1 Oct. 2, 2008

(51) Int. Cl.
*H01R 13/187* (2006.01)

(52) U.S. Cl. ..... 439/843

(58) Field of Classification Search ..... 439/843, 439/839, 746, 851, 886, 821
See application file for complete search history.

(56) References Cited

U.S. PATENT DOCUMENTS 4,550,972 A * 11/1985 Romak ..... 439/839
4,702,707 A * 10/1987 Hillbish ..... 439/80
4,906,212 A * 3/1990 Mixon, Jr. ..... 439/857
5,376,012 A * 12/1994 Clark ..... 439/80
5,516,310 A * 5/1996 Sawada ..... 439/843
5,591,039 A * 1/1997 Matthews ..... 439/181
5,667,413 A * 9/1997 Trafton ..... 439/843
5,775,960 A * 7/1998 Saito et al. ..... 439/843
6,186,841 B1 * 2/2001 Jacobsson ..... 439/851
6,250,974 B1 * 6/2001 Kerek ..... 439/843
6,773,285 B2 * 8/2004 Bernat et al. ..... 439/246
6,821,160 B2 * 11/2004 Fink et al. ..... 439/701
6,994,598 B2 * 2/2006 Holmes et al. ..... 439/752.5
7,115,003 B2 * 10/2006 Zhao et al. ..... 439/851
7,219,399 B2 * 5/2007 Tamm et al. ..... 24/136 R

* cited by examiner

*Primary Examiner*—Alexander Gilman

(57) ABSTRACT

A female connector terminal includes a connector terminal body, which has a positioning portion on the middle for positioning in an electrically insulative member, a bonding portion at the rear side for bonding to a circuit board, and a tubular contact portion at the front side that has a receiving contact hole for receiving a rod-like metal contact of a male connector terminal, an annular groove extending around the periphery, and a longitudinal split, and a clamping shell clamped on the periphery of the tubular contact portion within the annular groove to enhance contact connection between the tubular contact portion and the inserted male connector terminal and having a locating portion fastened to the longitudinal slit to prohibit rotation of the clamping shell relative to the tubular contact portion.

6 Claims, 9 Drawing Sheets

FEMALE CONNECTOR TERMINAL FOR ELECTRIC POWER CONNECTOR

This application claims the priority benefit of Taiwan patent application number 096205097 filed on Mar. 29, 2007.

BACKGROUND OF THE INVENTION

1. Field of the Invention

The present invention relates to electric power connectors and more specifically, to a female connector terminal, which has a tapered tubular contact portion for receiving a rod-like metal contact of a male connector terminal positively, and a clamping shell clamped on the tapered tubular contact portion to enhance contact connection between the tubular contact portion and the rod-like metal contact of the inserted male connector terminal.

2. Description of the Related Art

Following fast development of computer technology, the fabrication or application of many modern products has a great concern with electronic technology. Electronic technology has also been intensively employed to improve the quality of products. Therefore, many electronic technology-related products are commonly seen in our surroundings. The application of modern technology not only improves the quality of products but also gives added functions to the products. Therefore, regular electronic products are commonly equipped with many electric connectors, such as power connector, A/V connector, USB connector, RJ connector, memory connector, etc. for the connection of a variety of peripheral apparatus.

FIG. 8 illustrates an electric power connector set according to the prior art. According to this design, the electric power connector set is a first (male) connector A and a second (female) connector B. The first (male) connector A comprises an electrically insulative shell A1, and a male metal contact A2 mounted in the electrically insulative shell A1. The male metal contact A2 has a front extension plug portion A21. The second (female) connector B comprises an electrically insulative shell B1, and a female metal contact B2 mounted in the electrically insulative shell B1. The female metal contact B2 has a front tubular receiving portion B21 for receiving the front extension plug portion A21 of the male metal contact A2 of the first (male) connector A. This design of electric power connector set is still not satisfactory in function. Because the male metal contact A2 and the female metal contact B2 have a varied diameter along their length, frequently plugging the front extension plug portion A21 of the male metal contact A2 of the first (male) connector A into the front tubular receiving portion B21 of the female metal contact B2 of the second (female) connector B and removing the first (male) connector A from the second (female) connector B tend to cause stress concentration at the contact area, causing the metal contact A2 or B2 to be biased or deformed. Inserting the deformed first (male) connector A into the second (female) connector B with force will cause the second (female) connector B to split or to break, resulting in a connection failure.

In order to eliminate the aforesaid problem, another electric power connector set is developed, as shown in FIG. 9. According to this design, the electric power connector set comprises a first (male) connector terminal E and a second (female) connector terminal C for receiving the first (male) connector terminal E. The first (male) connector terminal E has a forwardly extending rod-like metal contact E1. The second (female) connector terminal C has a forwardly extending contact hole Cl for receiving the rod-like metal contact E1 of the first (male) connector terminal E, a recessed portion C2 extending around the periphery corresponding to the contact hole C1, and an elongated slot C3 cut through the periphery in communication between the contact hole C1 and the recessed portion C2. Further, a C-shaped clamping plate D is fitted into the recessed portion C2 and clamped on the periphery of the second (female) connector C. The contact hole C1 of the second (female) connector C has a diameter slightly greater than the rod-like metal contact E1 of the first (male) connector terminal E. After insertion of the rod-like metal contact E1 of the first (male) connector terminal E into the second (female) connector terminal C, the rod-like metal contact E1 cannot be kept in positive contact with the contact hole C1, and therefore the C-shaped clamping plate D is necessary to impart a compression force, forcing the contact hole C1 into contact with the rod-like metal contact E1 of the first (male) connector terminal E. However, because the C-shaped clamping plate D is smoothly arched, the smoothly arched inner surface does not give much friction force to the periphery of the second (female) connector terminal C. When inserting the rod-like metal contact E1 of the first (male) connector terminal E into the contact hole C1 of the second (female) connector terminal C, the C-shaped clamping plate D may rotate relative to the periphery of the second (female) connector terminal C. If an opening D1 between the two opposite side edges of the C-shaped clamping plate D is in alignment with the elongated slot C3, the C-shaped clamping plate D will be forced to extend outwards and to deform upon insertion of the rod-like metal contact E1 of the first (male) connector terminal E into the contact hole C1 of the second (female) connector terminal C, lowering the clamping force. When the clamping force of the C-shaped clamping plate D is reduced to a certain extent, the contact between the rod-like metal contact E1 of the first (male) connector terminal E and the contact hole C1 of the second (female) connector terminal C becomes unstable.

Therefore, it is desirable to provide an electric power connector set that eliminates the drawbacks of the aforesaid prior art designs.

SUMMARY OF THE INVENTION

The present invention has been accomplished under the circumstances in view. According to one aspect of the present invention, the female connector terminal is comprised of a connector terminal body and a clamping shell. The connector terminal body comprises a positioning portion for positioning in an electrically insulative member, a bonding portion axially extending from one end of the positioning portion for bonding to a circuit board, and a tubular contact portion axially extending from an opposite end of the positioning portion. The tubular contact portion comprises a receiving contact hole for receiving a rod-like metal contact of a male connector terminal, an annular groove extending around the periphery thereof, and at least one longitudinal split extending along the length in communication between the receiving contact hole and the annular groove. The clamping shell is clamped on the periphery of the tubular contact portion within the annular groove to enhance contact between the tubular contact portion and the rod-like metal contact of the inserted male connector terminal.

According to another aspect of the present invention, the clamping shell has a locating portion disposed at its one end thereof and fastened to the at least one longitudinal slit to prohibit rotation of the clamping shell relative to the tubular contact portion. Therefore, the clamping shell is positively secured to the tubular contact portion of the connector terminal body to enhance contact between the tubular contact portion and the rod-like metal contact of the inserted male connector terminal.

DETAILED DESCRIPTION OF THE PREFERRED EMBODIMENT

Figure 1:
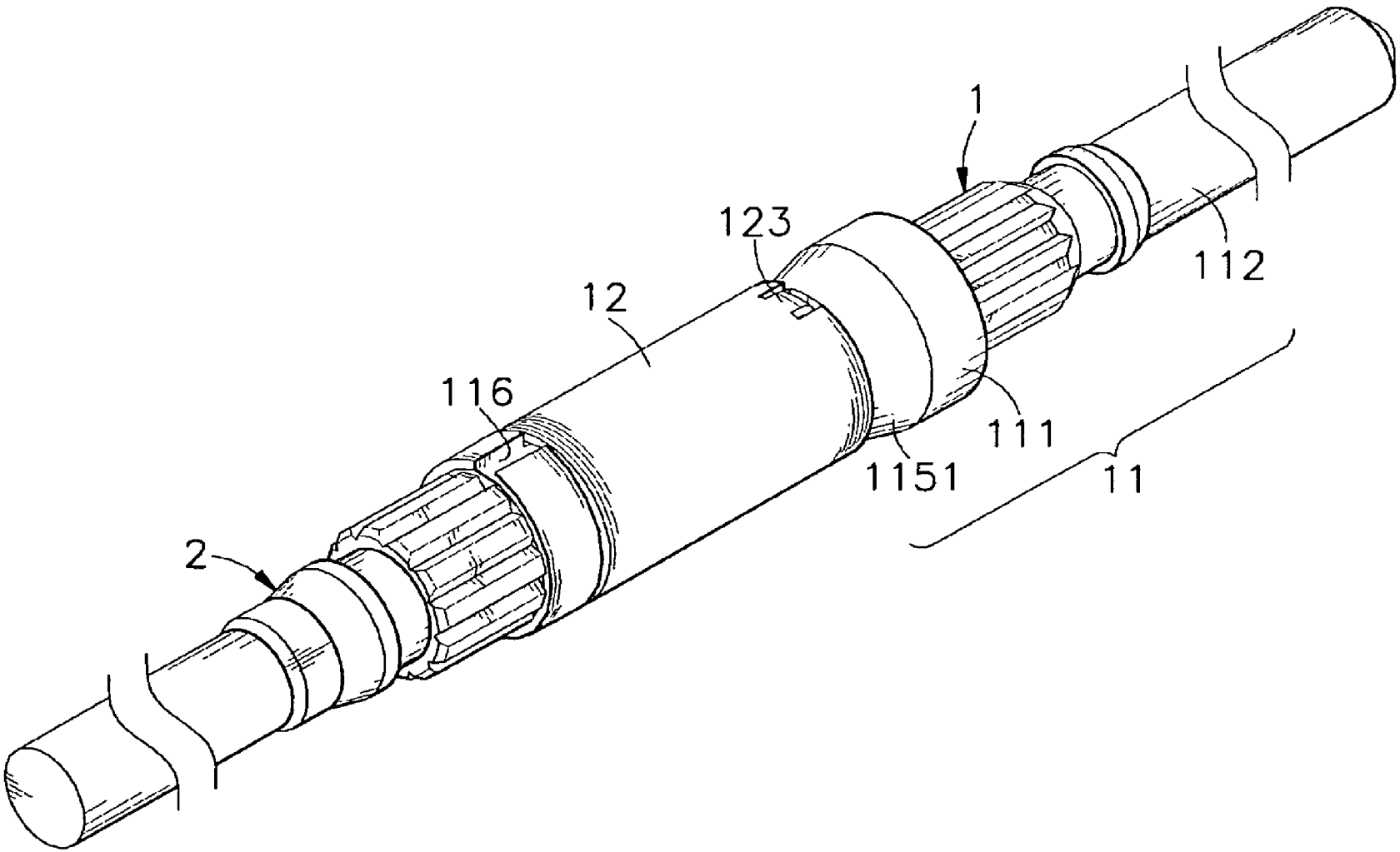
FIG. 1 is an elevational assembly view of a male connector terminal and a female connector terminal according to the present invention.
Figure 2:
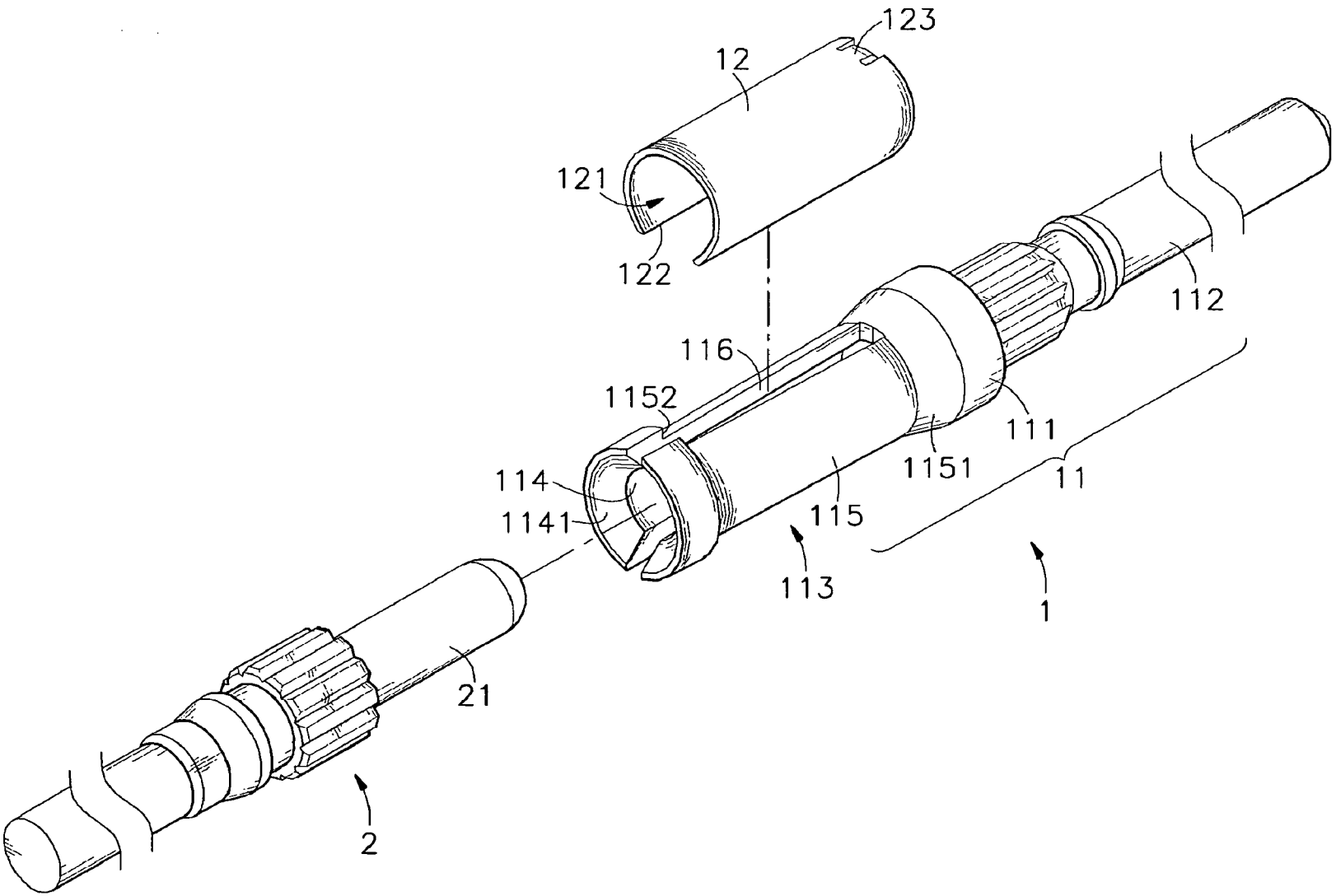
FIG. 2 is an exploded view of FIG. 1.
Figure 3:
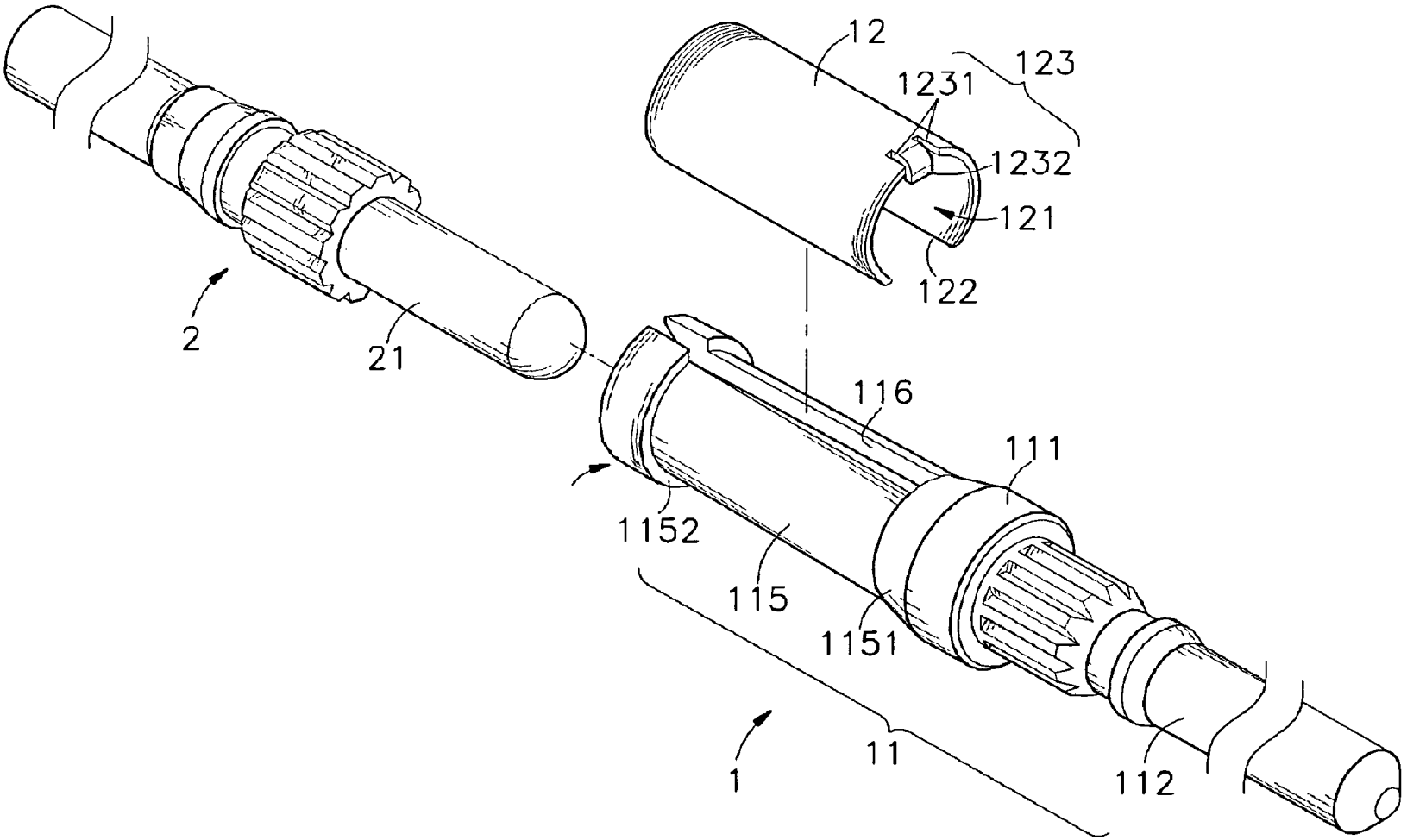
FIG. 3 corresponds to FIG. 2 when viewed from another angle.
Figure 4:
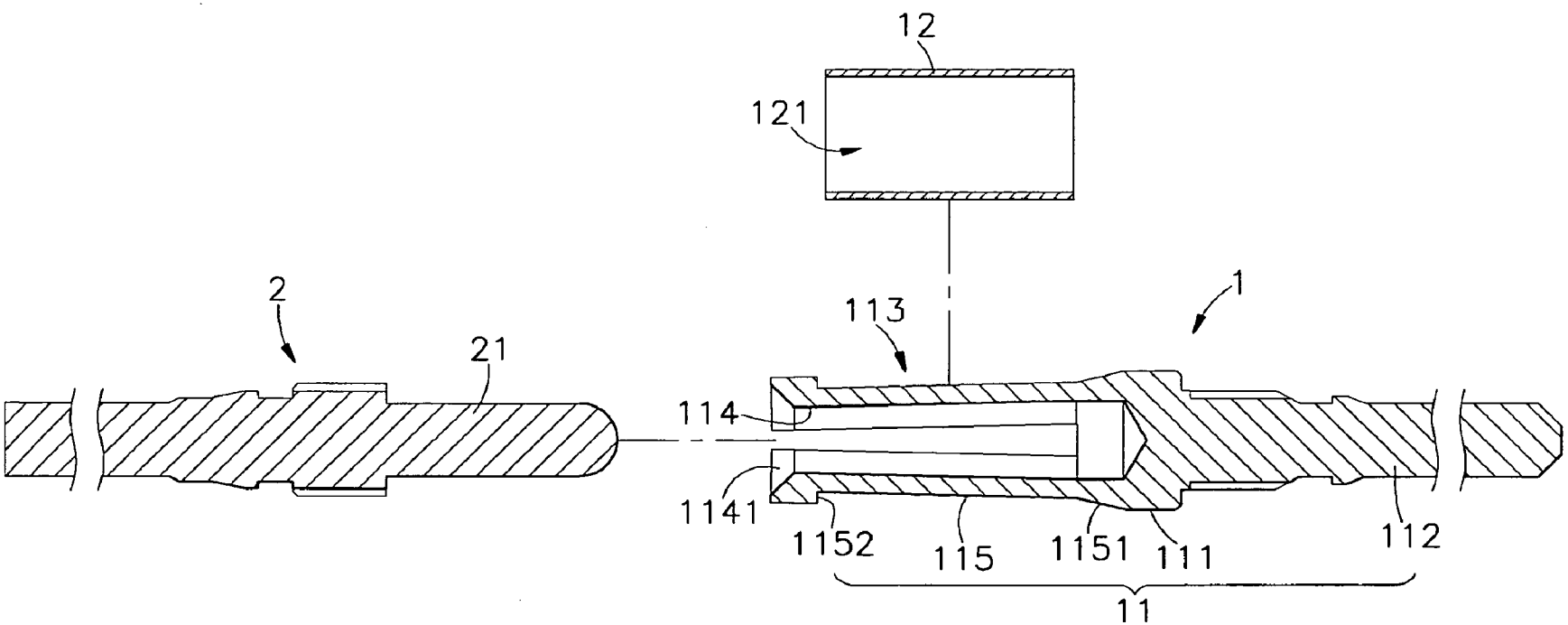
FIG. 4 is a sectional exploded view of the present invention.
Figure 5:
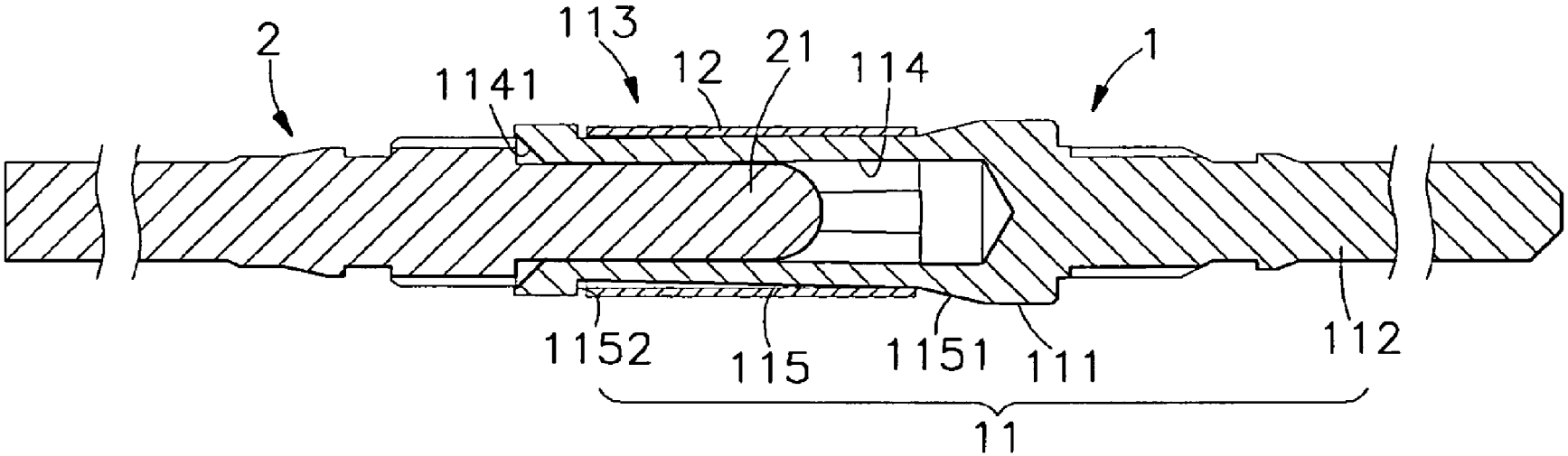
FIG. 5 is a sectional view of FIG. 1.
Figure 6:
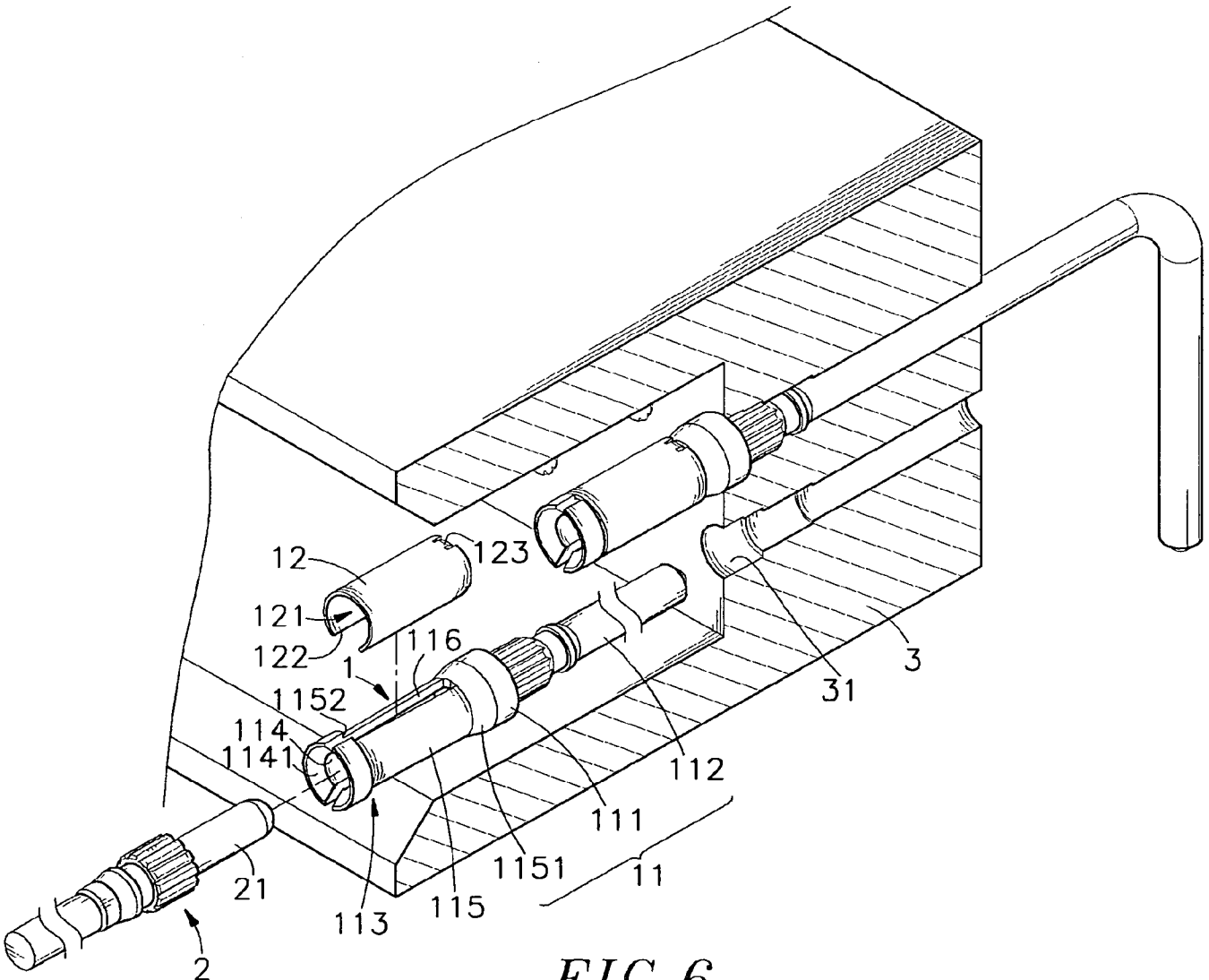
FIG. 6 is an exploded view of an electric power connector embodying the present invention.
Figure 7:
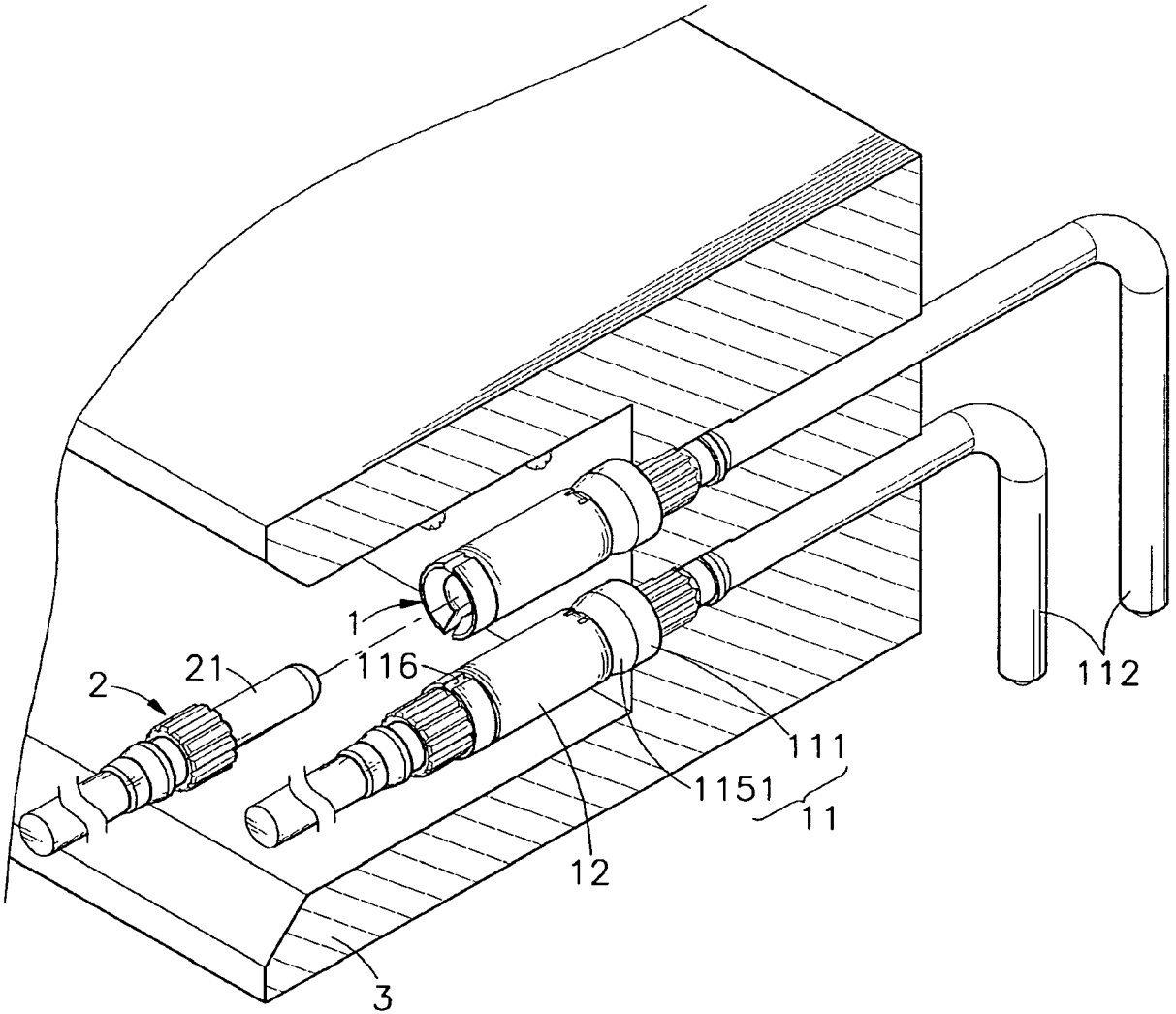
FIG. 7 corresponding to FIG. 6, showing the female connector terminal installed in the electrically insulative member.
Figure 8:
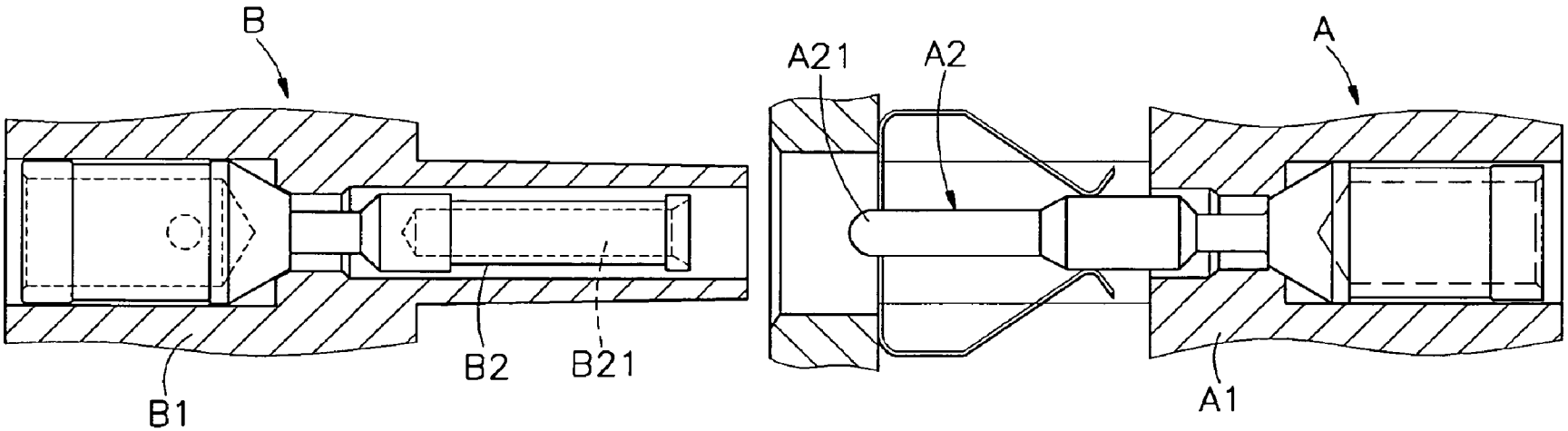
PRIOR ART FIG. 8
FIG. 8 is an exploded view in section of an electric power connector set according to the prior art.
Figure 9:
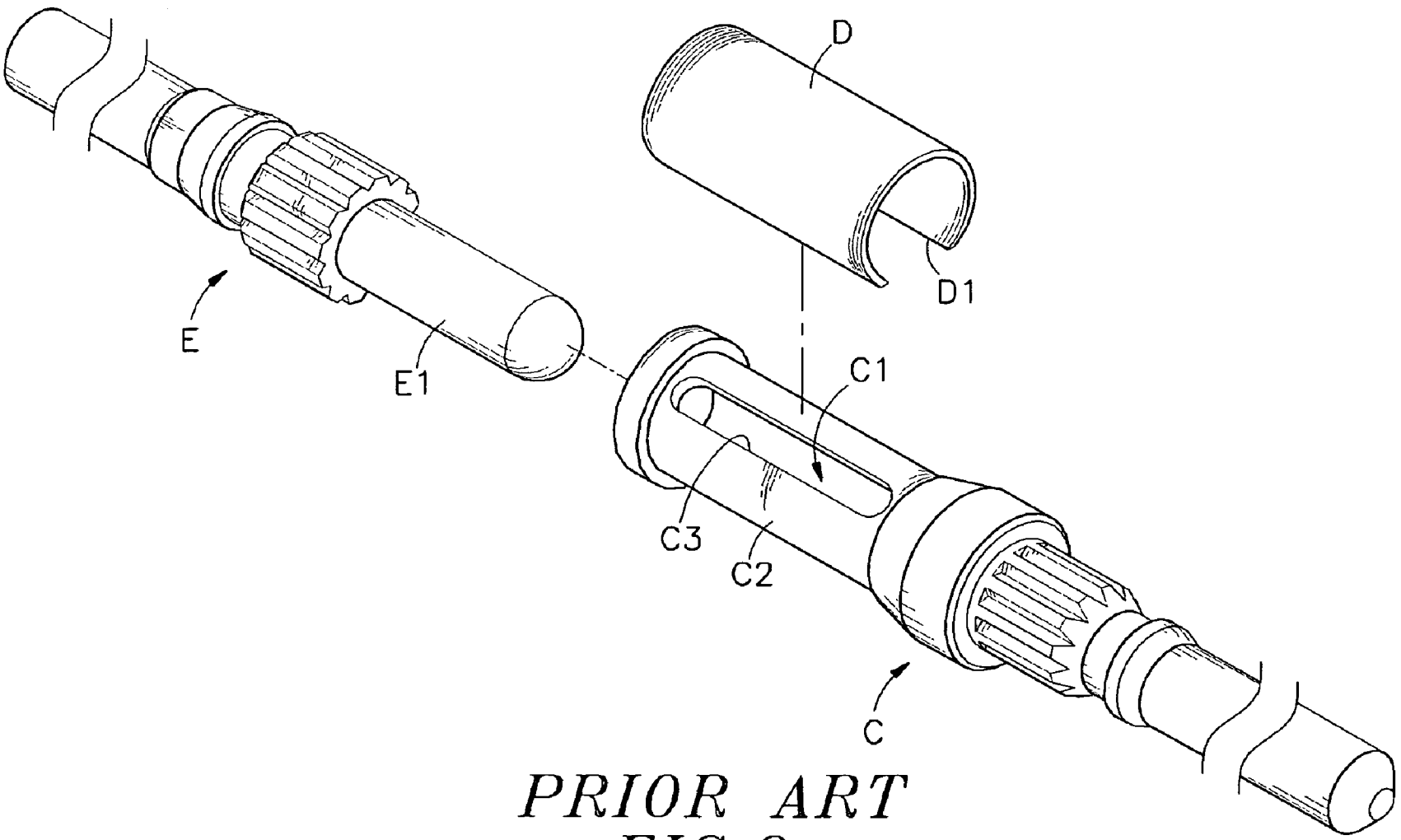
PRIOR ART FIG. 9
FIG. 9 is an exploded view of another design of electric power connector set according to the prior art.

Referring to FIGS. 1, 2 and 3, a female connector terminal 1 is shown for receiving a rod-like metal contact 21 of a male connector terminal 2. The female connector terminal 1 comprises a connector terminal body 11 and a clamping shell 12. The connector terminal body 11 comprises a positioning portion 111 for positioning in an electrically insulative member 3 (see also FIG. 6), a bonding portion 112 axially extending from one end of the positioning portion 111 for mounting, and a tubular contact portion 113 axially extending from the other end of the positioning portion 111. The tubular contact portion 113 has an outer diameter gradually reducing in direction away from the positioning portion 111. The tubular contact portion 113 comprises a receiving contact hole 114 axially extending to its front side for receiving the rod-like metal contact 21 of the male connector terminal 2, an annular groove 115 extending around the periphery, and at least one longitudinal split 116.

The clamping shell 12 is a split tube defining a receiving space 121 for receiving the tubular contact portion 113, and a longitudinal crevice 122 by which the clamping shell 12 can be opened and then attached to the annular groove 115 of the tubular contact portion 113. The clamping shell 12 has a locating portion 123 protruded from its one end corresponding to the longitudinal split 116 of the connector terminal body 11.

The tubular contact portion 113 of the connector terminal body 11 has a beveled guide edge 1141 at the front end of the receiving contact hole 114 to facilitation insertion of the rod-like metal contact 21 of a male connector terminal 2, a tapered face 1151 extending around one end, namely, the rear end of the annular groove 115 and abutted against the positioning portion 111, and stop flange 1152 extending around the other one end, namely, the front end of the annular groove 115. The locating portion 123 comprises two end notches 1231 at one end of the clamping shell 12, and a hook block 1232 formed of a part of the clamping shell 12 and curved downwards between the end notches 1231.

Referring to FIGS. 4-7, the connector terminal body 11 is fixedly mounted in the electrically insulative member 3 to have the positioning portion 111 be positioned in one terminal hole 31 of the electrically insulative member 3 and the bonding portion 112 be extended out of the electrically insulative member 3 and bonded to a circuit board (not shown), and then the clamping shell 12 is fastened to the annular groove 115 of the tubular contact portion 113 to hook the hook block 1232 into the longitudinal split 116. After installation of the female connector terminal 1, the rod-like metal contact 21 of the male connector terminal 2 is inserted into the receiving contact hole 114 of the tubular contact portion 113 of the connector terminal body 11 of the female connector terminal 1. Because the tubular contact portion 113 is tapered, insertion of the rod-like metal contact 21 of the male connector terminal 2 into the receiving contact hole 114 of the tubular contact portion 113 cause the tubular contact portion 113 to expand, and at the same time the clamping shell 12 imparts a compression force to the tubular contact portion 113, and therefore the rod-like metal contact 21 of the male connector terminal 2 and the tubular contact portion 113 of the connector terminal body 11 of the female connector terminal 1 are kept in positive contact with each other.

Further, during installation of the clamping shell 12, the longitudinal crevice 122 is perpendicularly attached to the annular groove 115 of the tubular contact portion 113, and the hook block 1232 is moved with the clamping shell 12 along the tapered face 1151 into the longitudinal split 116. After the hook block 1232 is engaged into the longitudinal split 116, the front end of the clamping shell 12 is stopped against the stop flange 1152 of the tubular contact portion 113. After installation, the springy material property of the clamping shell 12 forces the clamping shell 12 to clamp on the periphery of the tubular contact portion 113 positively within the annular groove 115 and stopped against the stop flange 1152, and the engagement between the hook block 1232 of the clamping shell 12 and the longitudinal split 116 of the tubular contact portion 113 prohibits rotation of the clamping shell 12 relative to the tubular contact portion 113 of the connector terminal body 11 of the female connector terminal 1.

When inserting the rod-like metal contact 21 of the male connector terminal 2 into the receiving contact hole 114 of the tubular contact portion 113 of the connector terminal body 11 of the female connector terminal 1, the beveled guide edge 1141 guides the rod-like metal contact 21 into the tubular contact portion 113 accurately. Because the clamping shell 12 is prohibited from rotation relative to the tubular contact portion 13, the longitudinal crevice 122 of the clamping shell 12 is constantly kept away from the longitudinal split 116 of the tubular contact portion 113, and the expansion of the tubular contact portion 113 upon insertion of the rod-like metal contact 21 into the tubular contact portion 113 does not cause the clamping shell 12 to spread out. Therefore, the clamping shell 12 positively holds down the tubular contact portion 113, keeping the tubular contact portion 113 in positive contact with the rod-like metal contact 21 of the male connector terminal 2.

As stated above, the female connector terminal of the present invention has the following features and advantages:

1. The tubular contact portion 113 is tapered and has a longitudinal split 116. When inserting the rod-like metal contact 21 of the male connector terminal 2 into the receiving contact hole 114 of the tubular contact portion 113, the longitudinal split 116 is forced to expand for easy insertion of the rod-like metal contact 21 into the receiving contact hole 114. After insertion of the rod-like metal contact 21 into the receiving contact hole 114, the tubular contact portion 113 immediately returns to its former shape to hold the rod-like metal contact 21 in positive contact with its inside wall.

2. The hook block 1232 of the locating portion 123 of the clamping shell 12 is engaged into the longitudinal split 116 of the tubular contact portion 113. Therefore, the clamping shell 12 is prohibited from rotation relative to the tubular contact portion 113, and will not fall from the tubular contact portion 113.

3. The clamping shell 12 prevents excessive expansion of the tubular contact portion 113 during insertion of the rod-like metal contact 21 into the receiving contact hole 114, enhancing positive contact between the tubular contact portion 113 and the rod-like metal contact 21.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A female connector terminal comprising a connector terminal body for receiving a rod-like metal contact of a male connector terminal and a clamping shell clamping on said connector terminal body to enhance connection between said connector terminal body and said rod-like metal contact of said male connector terminal that is inserted in said connector terminal body, wherein said connector terminal body comprises a positioning portion for positioning in an electrically insulative member, a bonding portion axially extending from one end of said positioning portion for bonding to a circuit board, and a tubular contact portion axially extending from an opposite end of said positioning portion, said tubular contact portion comprising a receiving contact hole for receiving said rod-like metal contact of said male connector terminal, an annular groove extending around the periphery thereof, and at least one longitudinal split extending along the length thereof in communication between said receiving contact hole and said annular groove; said clamping shell defines a receiving space, which receives said tubular contact portion, a longitudinal crevice extending through the length thereof, and a locating portion protruded from one end thereof for fastening to said at least one longitudinal slit to prohibit rotation of said clamping shell relative to said tubular contact portion.

2. The female connector terminal as claimed in claim 1, wherein said tubular contact portion has an outer diameter gradually reducing in direction away from said positioning portion.

3. The female connector terminal as claimed in claim 1, wherein said tubular contact portion of said connector terminal body has a beveled guide edge at a front end of said receiving contact hole.

4. The female connector terminal as claimed in claim 1, wherein said tubular contact portion of said connector terminal body has a tapered face extending around one end of said annular groove and abutted against said positioning portion, and stop flange extending around an opposite end of said annular groove for stopping said clamping shell in said annular groove.

5. The female connector terminal as claimed in claim 1, said clamping shell has an annular shape.

6. The female connector terminal as claimed in claim 1, wherein said locating portion of said clamping shell comprises at least one hook block suspending from one end thereof for hooking in one of said at least one longitudinal split of said tubular contact portion, and two end notches at two opposite sides of each of said at least one hook block.

* * * * *